US011250693B2

(12) United States Patent
Dodge et al.

(10) Patent No.: US 11,250,693 B2
(45) Date of Patent: Feb. 15, 2022

(54) KEYFOB RETAINING TOOL

(71) Applicant: Nissan North America, Inc., Franklin, TN (US)

(72) Inventors: Luke Dodge, Madison, MS (US); Mark Tilley, Ridgeland, MS (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 281 days.

(21) Appl. No.: 16/657,449

(22) Filed: Oct. 18, 2019

(65) Prior Publication Data

US 2021/0118284 A1 Apr. 22, 2021

(51) Int. Cl.
*G07C 9/00* (2020.01)
*G08C 17/02* (2006.01)

(52) U.S. Cl.
CPC ..... *G08C 17/02* (2013.01); *G07C 9/00182* (2013.01); *G07C 2009/00238* (2013.01); *G08C 2201/20* (2013.01)

(58) Field of Classification Search
CPC ..... G07C 2009/00238; G07C 9/00182; G07C 9/00706; G07C 9/00896; G07C 9/00944; G08C 17/02; G08C 2201/20
See application file for complete search history.

(56) References Cited

U.S. PATENT DOCUMENTS 7,415,379 B2 8/2008 Powell et al.
7,463,134 B1 * 12/2008 Stilley ..... A45C 11/18 340/5.61
7,771,075 B2 * 8/2010 Luyckx ..... F21L 4/085 362/183
8,672,083 B2 * 3/2014 Lee ..... F02N 11/0807 180/315
2006/0155439 A1 * 7/2006 Slawinski ..... G07C 5/0858 701/33.4
2017/0287326 A1 10/2017 Majtan

* cited by examiner

*Primary Examiner* — Yong Hang Jiang
(74) *Attorney, Agent, or Firm* — Global IP Counselors, LLP

(57) ABSTRACT

A keyfob retaining tool includes an ignition switch retaining section, a keyfob retaining section attached to the ignition switch retaining section and an ignition switch installed to the ignition switch retaining section. The ignitions switch is configured to temporarily connect to wiring of a vehicle for electronic communication with an ECM (electronic control module) of the vehicle. The keyfob retaining section is configured to temporarily retain a keyfob adjacent to the ignition switch such that the keyfob establishes a communication connection via the ignition switch with the ECM of the vehicle in order to electronically pair the keyfob with the ECM of the vehicle.

17 Claims, 7 Drawing Sheets

KEYFOB RETAINING TOOL

BACKGROUND

Field of the Invention

The present invention generally relates to a handheld keyfob retaining tool. More specifically, the present invention relates to a handheld keyfob retaining tool that includes a vehicle ignition switch configured to temporarily connect to an electronic control module (ECM) of a vehicle such that with a keyfob installed to the hand-held keyfob retaining tool, the ECM can be programed to recognize, link to and respond to commands sent from the keyfob.

Background Information

Many vehicles include a wireless communication system that detects the presence of and receives commands from a keyfob. During the vehicle assembly process, the electronic control module (ECM) of the vehicle is typically programmed to recognize the presence of the keyfob and respond to commands from the keyfob.

SUMMARY

One object of the present disclosure is to provide a technician working on a vehicle assembly line with a handheld tool that assists with programing an electronic control module (ECM) of a vehicle to recognize, link to and respond to commands from a keyfob that is temporarily inserted into the handheld tool.

In view of the state of the known technology, one aspect of the present disclosure is to provide a keyfob retaining tool with an ignition switch retaining section, a keyfob retaining section attached to the ignition switch retaining section and an ignition switch installed to the ignition switch retaining section. The ignitions switch is configured to temporarily connect to wiring of a vehicle for electronic communication with an ECM (electronic control module) of the vehicle. The keyfob retaining section is configured to temporarily retain a keyfob adjacent to the ignition switch such that the keyfob establishes a communication connection via the ignition switch with the ECM of the vehicle in order to electronically pair the keyfob with the ECM of the vehicle.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
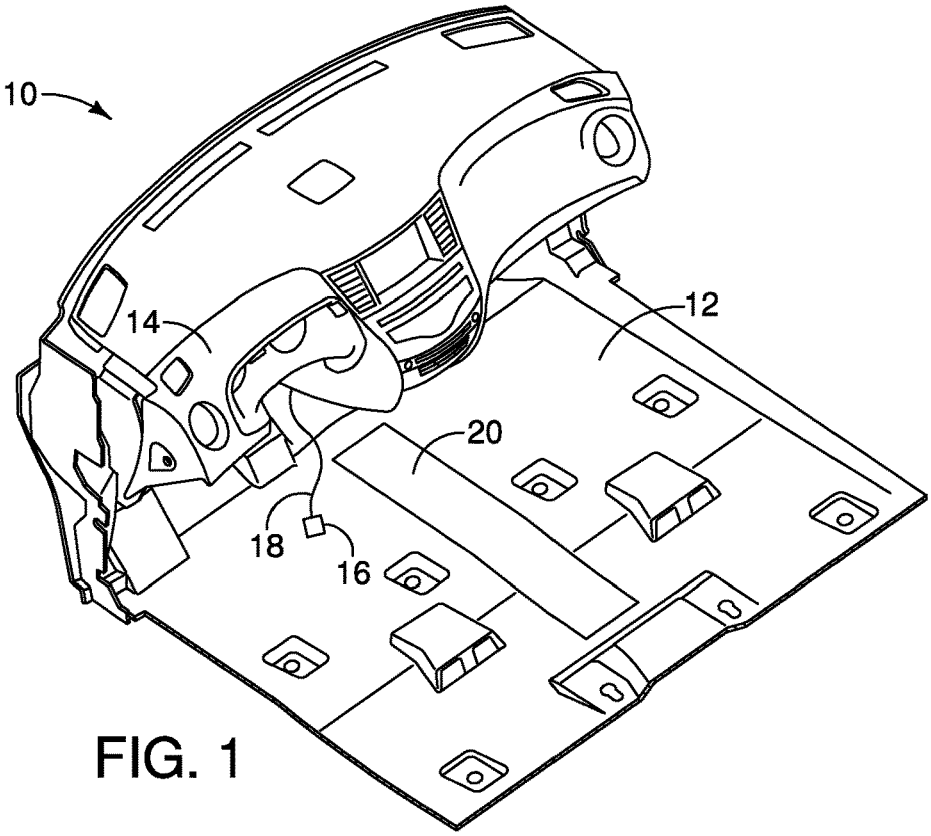
FIG. 1 is a perspective view of a passenger compartment of a vehicle located at an assembly station of a vehicle assembly line showing a wiring harness with a connector and a floor structure configured to receive a center console that has not yet been installed in accordance with one embodiment.

Referring initially to FIG. 1, a portion of a vehicle 10 is illustrated in accordance with a first embodiment. The vehicle 10 shown in FIGS. 1-4 in a state of partial assembly while in a factory production line (not shown) during construction of the vehicle 10. The vehicle 10 includes a floor structure 12, an instrument panel 14, a wiring connector 16 of a wiring harness 18 (shown in FIG. 5) and a central area 20 of the floor structure 12 configured to receive a center console 22 (FIG. 4).

Figure 2:
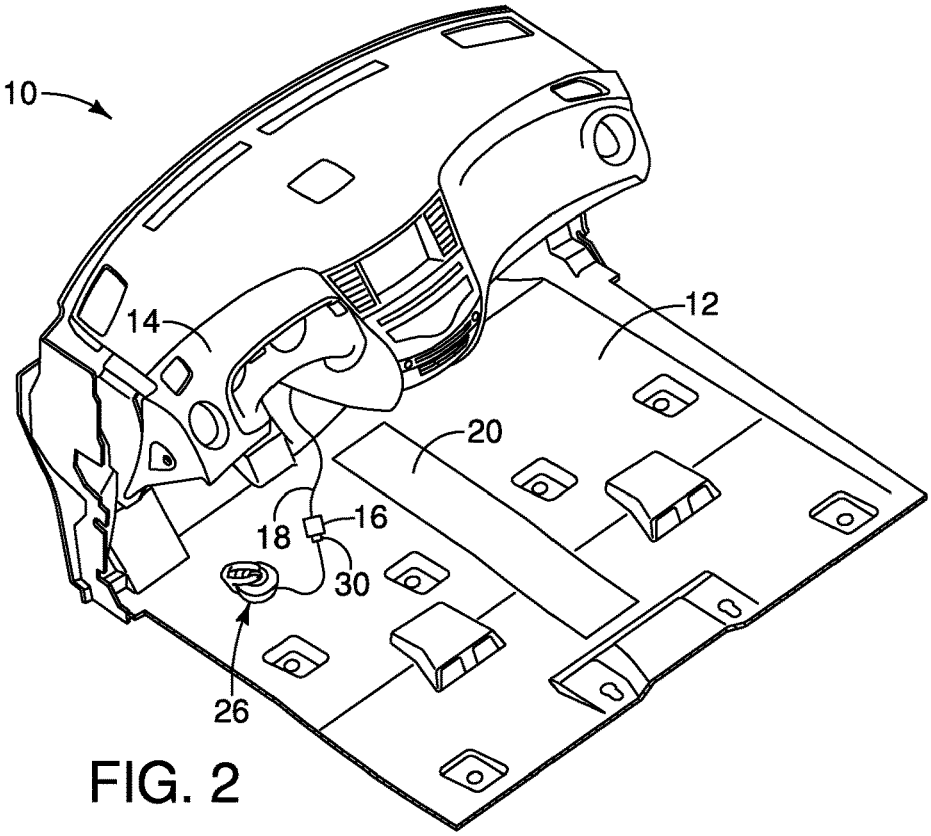
FIG. 2 is another perspective view of the passenger compartment showing a handheld keyfob retaining tool that includes a temporary ignition switch that is connected to the connector of the wiring harness in accordance with the one embodiment.
Figure 3:
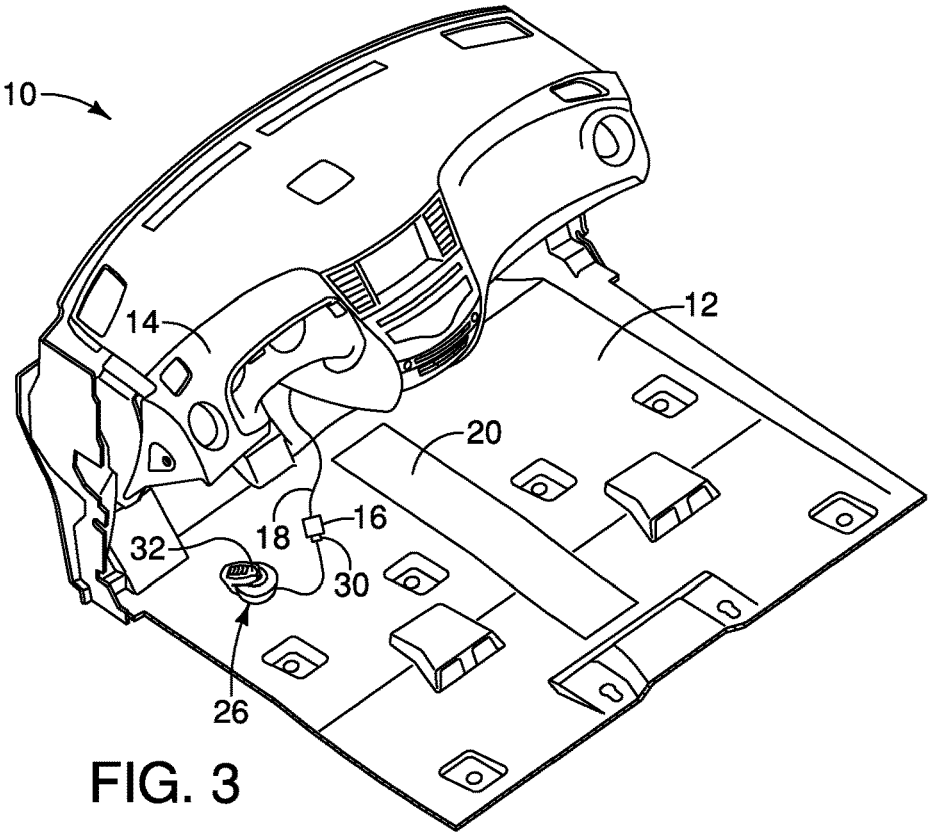
FIG. 3 is yet another perspective view of the passenger compartment showing the handheld keyfob retaining tool temporarily installed to the connector of the wiring harness with a keyfob inserted therein for pairing with electronic components of the vehicle in accordance with the one embodiment.

In FIGS. 2 and 3, a keyfob retaining tool 26 (a handheld tool) is shown connected to the wiring connector 16, as is described in greater detail below. The keyfob retaining tool 26 is configured for use during the assembly of the vehicle assembly.

FIG. 1 shows the vehicle 10 as is would appear at an assembly line station (not shown) of factory production line (not shown) with the wiring connector 16 exposed beneath a central area of the instrument panel 14. FIG. 2 shows an electrical connector 30 of the keyfob retaining tool 26 connected to the connector 16 of the wiring harness 18. In FIG. 3, a keyfob 32 is installed into the keyfob retaining tool 26 enabling programming of the vehicle 10 to recognize and respond to the keyfob 32, as is described further below.

Figure 4:
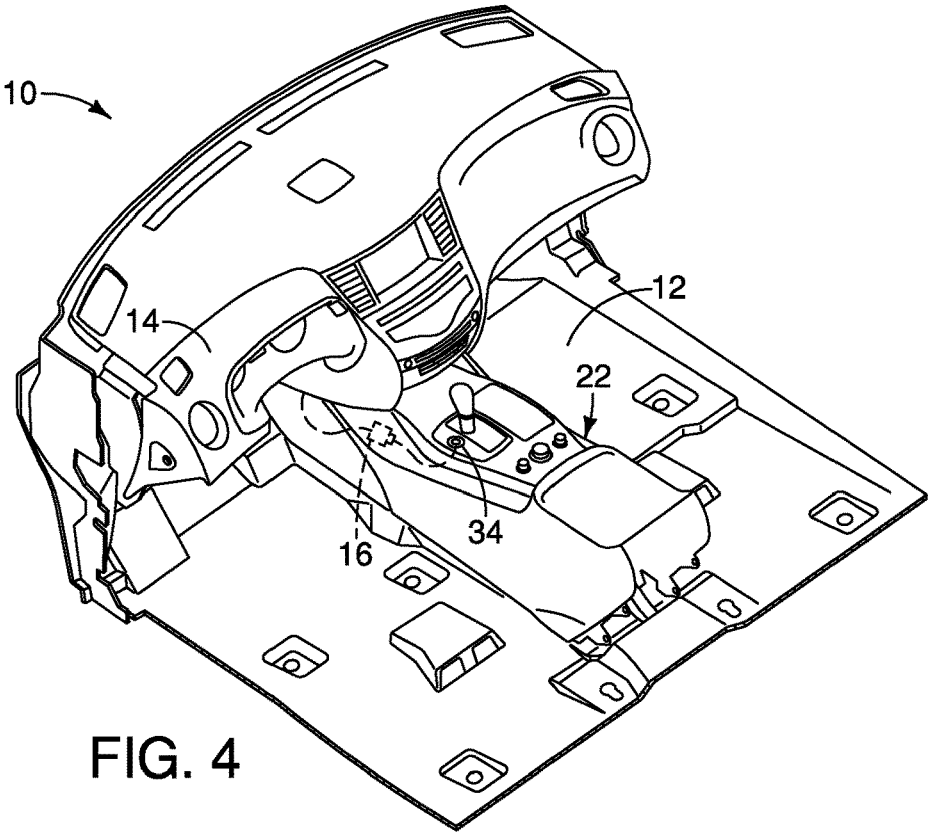
FIG. 4 is still another perspective view of the passenger compartment showing the handheld keyfob retaining tool removed from connector of the wiring harness after completion of the pairing of the keyfob with the electronic components of the vehicle, with the center console installed to the floor, the center console having a permanent ignition switch connected to the connector and electronic components of the vehicle in accordance with the one embodiment.

In FIG. 4, the vehicle 10 has been programmed to recognize and respond to commands from the keyfob 32, and therefore the keyfob retaining tool 26 and the keyfob 32 have been removed. Further, the center console 22 has been installed to the floor structure 12. The center console 22 includes a permanent ignition switch 34 has been electronically connected to the vehicle 10 via the connector 16.

Figure 5:
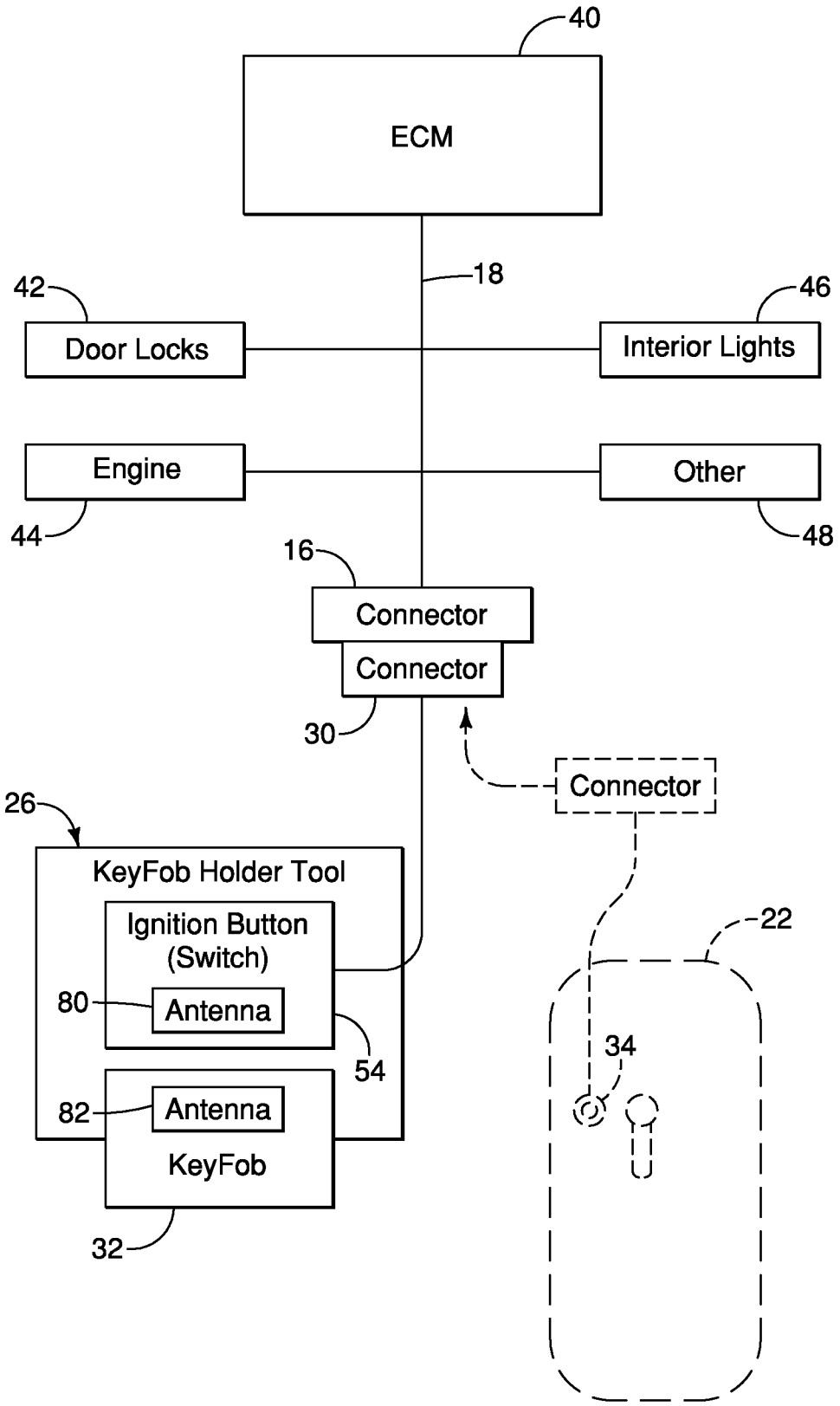
FIG. 5 is a block diagram schematically showing select portion of the electronic components of the vehicle, including an electronic control module (ECM), interior lights, door locks, engine and wiring harness, as well as other electronic components, along with the handheld keyfob retaining tool temporarily connected to the wiring harness, with the center console and the permanent ignition switch in phantom waiting to be installed after completion of linking the keyfob with the ECM in accordance with the one embodiment.

As shown in FIG. 5, the vehicle 10 also includes an electronic control module 40 (referred to herein after as an ECM 40). The ECM 40 is connected to the wiring harness 18 which further electronically connects the ECM 40 to a variety of electronic components, sensors and vehicle systems including, but not limited to, door locks 42, a vehicle engine 44, interior lights 46, and other vehicle components 48 such as the transmission, alternator, as well as other conventional vehicle components.

A description of the keyfob retaining tool 26 is now provided with specific reference to FIGS. 6-13. Thereafter, a description of use of the keyfob retaining tool 26 is provided.

Figure 6:
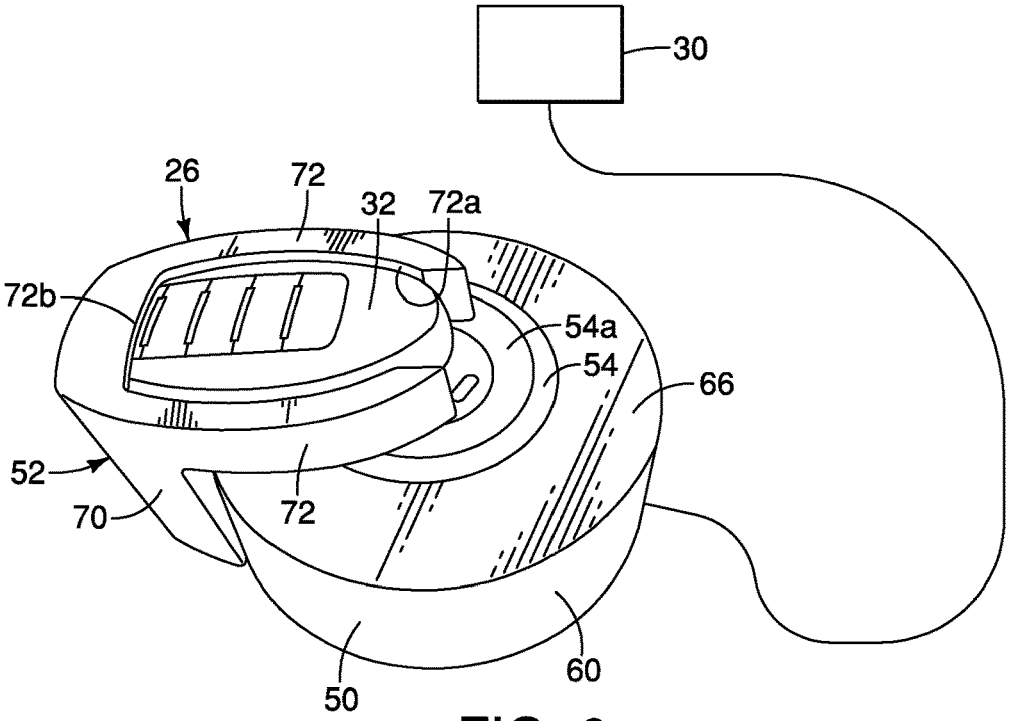
FIG. 6 is a perspective view of the keyfob retaining tool with a keyfob inserted therein in accordance with the one embodiment.
Figure 7:
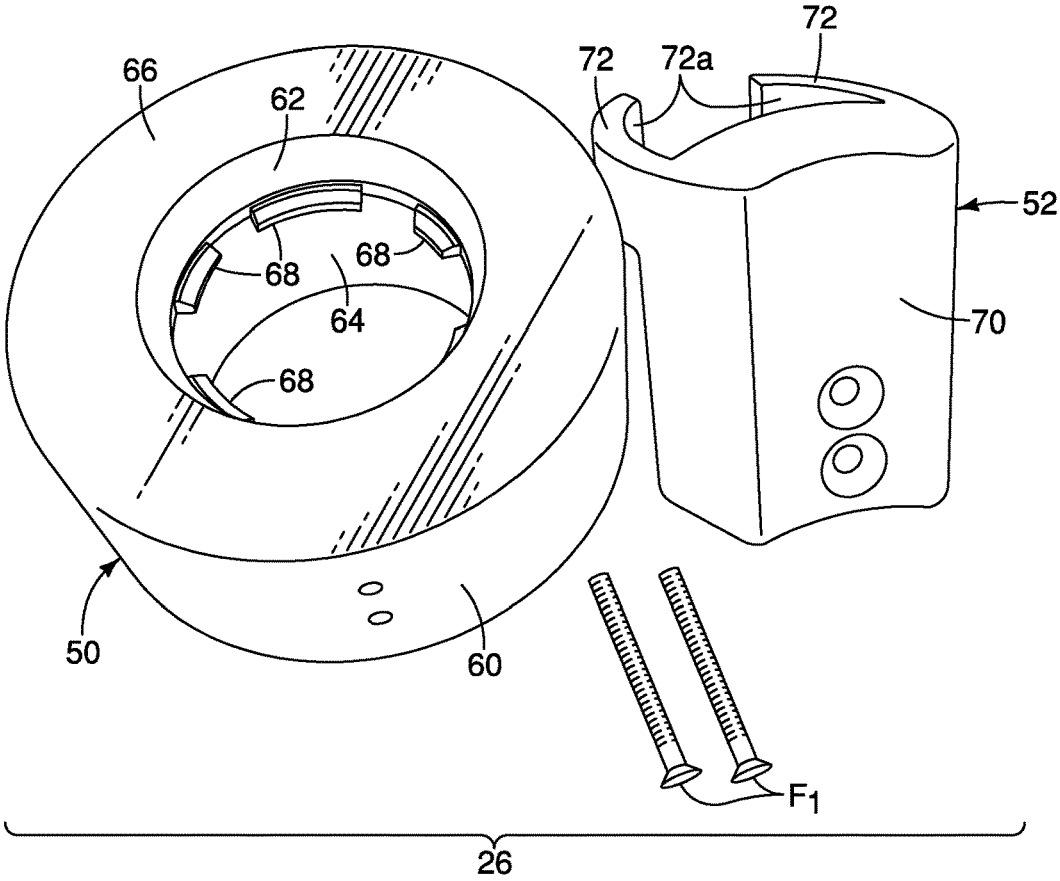
FIG. 7 is another perspective view of elements of the keyfob retaining tool shown disassembled, including a keyfob retaining portion and an ignition switch retaining portion in accordance with the one embodiment.
Figure 8:
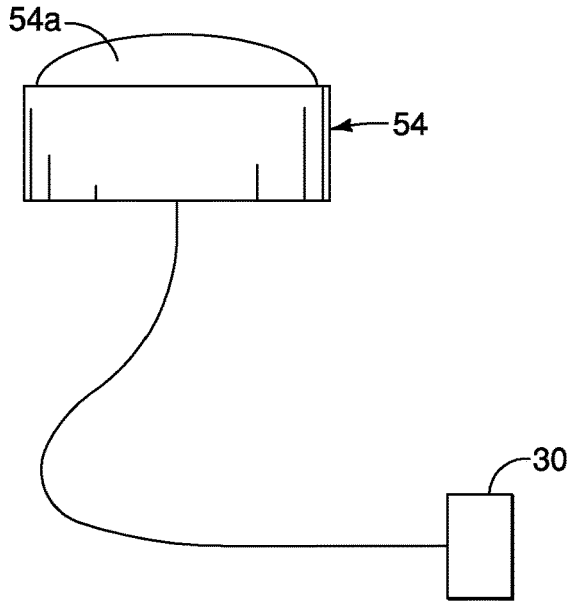
FIG. 8 is a side view of an ignition switch that is used in the keyfob retaining tool shown in accordance with the one embodiment.

As shown in FIGS. 6 and 7, the keyfob retaining tool 26 is basically a handheld structure that is small enough to fit on the palm of a technician's hand. The keyfob retaining tool 26 includes an ignition switch retaining section 50, a keyfob retaining section 52 attached to the ignition switch retaining section 50 and a temporary ignition switch 54. As shown in FIG. 5, the ignition switch 54 includes an antenna 80 that connects to the ECM 40 via the connectors 16 and 30.

Figure 9:
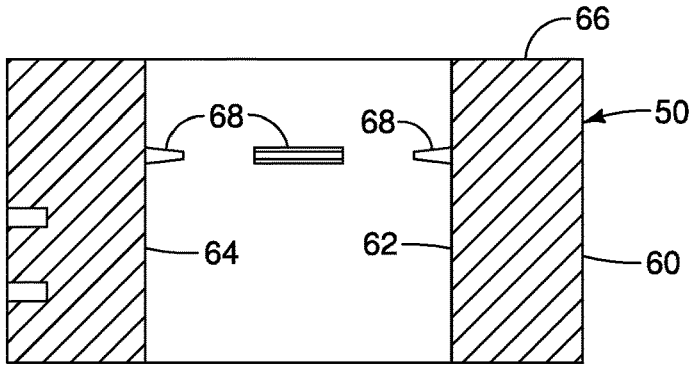
FIG. 9 is a cross-sectional view of the ignition switch retaining portion showing a central opening extending therethrough, and a plurality of projections that extend radially inward from a cylindrically shaped surface that defines the opening in accordance with the one embodiment.
Figure 11:
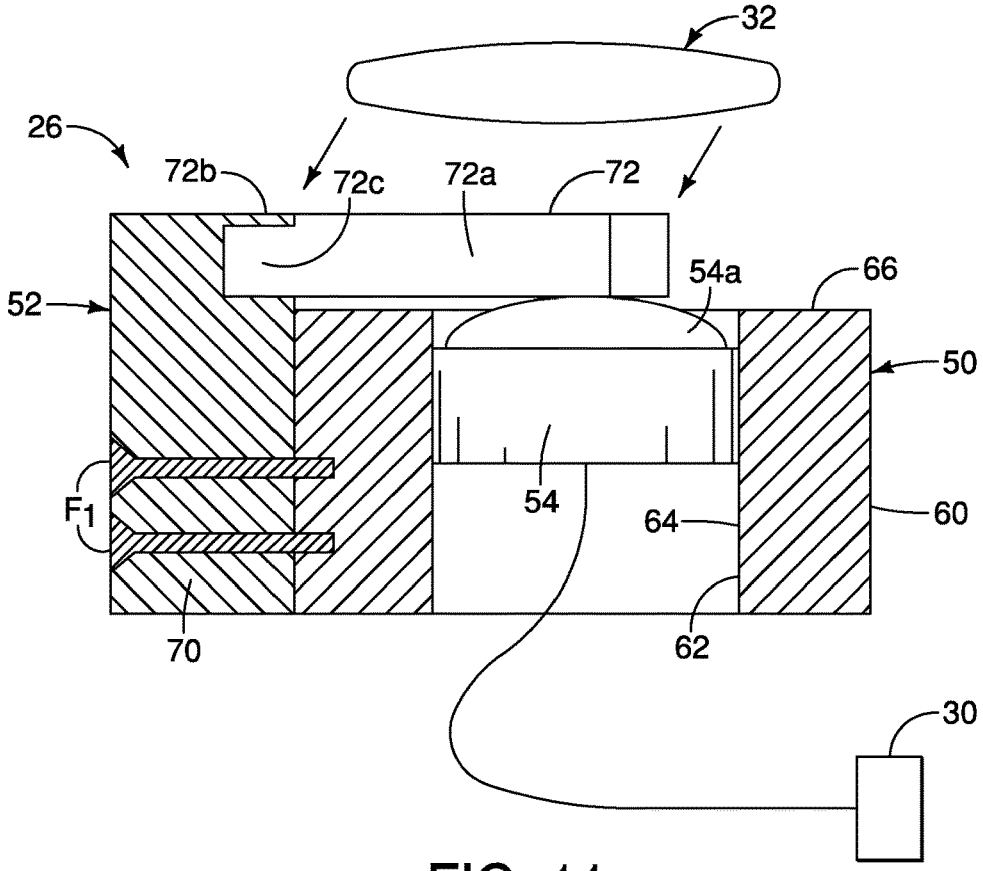
FIG. 11 is another cross-sectional view of the keyfob retaining tool without the keyfob showing the keyfob retaining portion fixed to the ignition switch retaining portion in accordance with the one embodiment.
Figure 12:
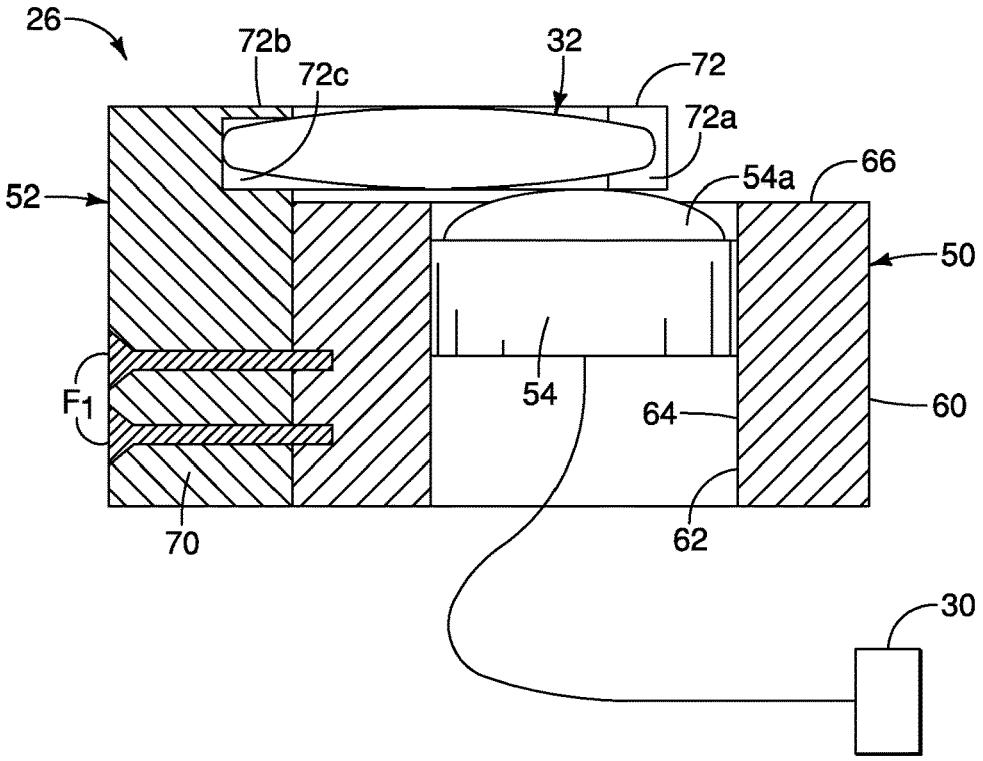
FIG. 12 is another cross-sectional view of the keyfob retaining tool showing the keyfob installed to the keyfob retaining portion in accordance with the one embodiment.
Figure 13:
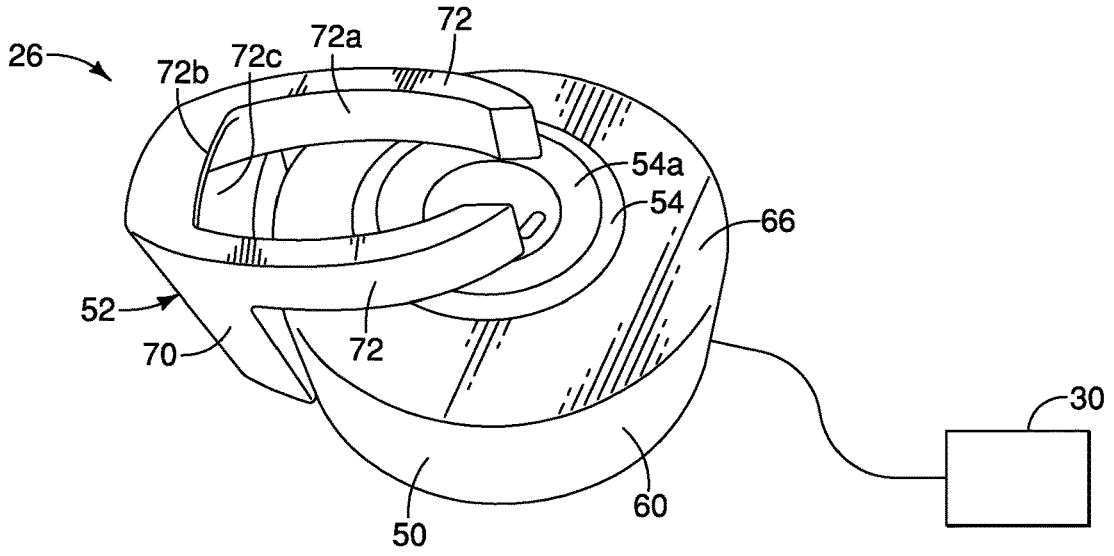
FIG. 13 is a perspective view of the keyfob retaining tool with the keyfob removed therefrom in accordance with the one embodiment.

As shown in FIGS. 6, 7, 9 and 11-12, the ignition switch retaining section 50 basically has an overall annular shape (ring shape) with an outer cylindrical surface 60, a central opening 62 defined by an inner cylindrically shaped surface 64 and an upper annular surface 66. As shown in FIGS. 7 and 9, the inner cylindrically shaped surface 62 includes a plurality of radially inwardly extending projections 68. The plurality of radially inwardly extending projections 68 are dimensioned to retain the temporary ignition switch 54 within the opening 62, as shown in FIGS. 6, 11 and 12.

As shown in FIGS. 6, 11 and 12, the keyfob retaining section 52 is configured to temporarily retain the keyfob 32 therein adjacent to the ignition switch 54. As shown in FIGS. 6-7, 10 and 13, the keyfob retaining section 52 includes an attachment section 70 and a pair of arms 72 that are cantilevered from the attachment section 70. With the keyfob retaining section 52 attached to the ignition switch retaining section 50, the pair of arms 72 extend away from the attachment section 70 over a portion of the upper annular surface 66 of the ignition switch retaining section 50 and over the opening 62 of the ignition switch retaining section 50.

The pair of arms 72 are flexible, resilient and are biased toward one another in order to removably retain the keyfob 32 therebetween. In the depicted embodiment, the keyfob 32 has an oval shape. Inner surfaces **72*a* of the pair of arms 72 face one another. The inner surfaces 72*a* have curved surfaces that are shaped to conform to the overall shape of the keyfob 32. When at rest (FIG. 13) with the keyfob 32 absent, the inner surfaces 72*a* are spaced apart from one another with distances therebetween that are smaller than the corresponding widths of the keyfob 32. To install the keyfob 32 between the inner surfaces 72*a*, the pair of arms 72 must be moved away from one another. However, since the pair of arms 72 are flexible and resilient, little effort is necessary to install (and later remove) the keyfob 32 from the keyfob retaining section 52**.

Figure 10:
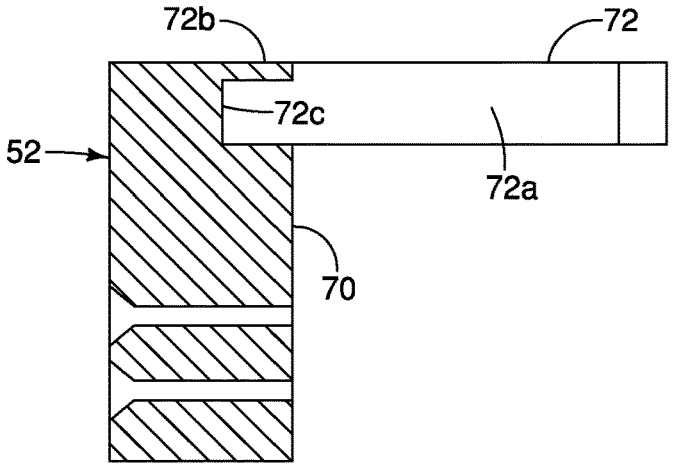
FIG. 10 is a cross-sectional view of the keyfob retaining portion a pair of cantilevered arms shaped to retain the keyfob in accordance with the one embodiment.

As shown in FIGS. 6 and 10-13, the keyfob retaining section 52 includes a thin wall **72*a*. The thin wall 72*a* extends between ends of the pair of arms 72 above the attachment section 70. As shown in FIGS. 10-12, the thin wall 72*a* defines a small pocket 72*c* that is dimensioned to receive one end of the keyfob 32 providing alignment and orientation surfaces for the keyfob 32**.

In order to provide the flexibility needed for movement of the pair of arms 72, the keyfob retaining section 52 can be made of a rubber, rubber-like material, polymer materials, resin materials, or any other suitable material that provides the pair of arms 72 with sufficient flexibility to install and remove the keyfob 32 with little effort or force. Similarly, the ignition switch retaining section 50 can be made of the same material as the keyfob retaining section 52 or can be made of more rigid materials. The projections 68 within the opening 62 can be made of a flexible material different than the material of the ignition switch retaining section 50 or can be made of the same material as the ignition switch retaining section 50.

The keyfob retaining section 52 is attached to an outer surface of the ignition switch retaining section via a pair of mechanical fasteners Fi, as shown in FIGS. 11 and 12.

The temporary ignition switch 54 is a factory produced ignition switch mechanism that is functionally and operably identical to the permanent ignition switch 34 installed to the center console 22. The temporary ignition switch 54 is installed within the opening 62 of the ignition switch retaining section 50 and remains installed to the keyfob retaining tool 26 due to contact with the projections 68 within the opening 62 of the ignition switch retaining section 50. The temporary ignition switch 54 includes a wiring harness that is electronically connected to the connector 30. When the connector 30 is attached and/or connected to the connector 16, the temporary ignition switch 54 is electronically connected to the ECM 40.

The handheld keyfob retaining tool 26 is configured to temporarily connect the ignition switch 54 to the connector 16 of the wiring harness 18 of the vehicle 10 in order to program the ECM 40 of the vehicle 10 to recognize the keyfob 32 and respond to instructions received from the keyfob 32, as described in greater detail below.

As shown in FIGS. 6 and 11-13, an exposed upper surface of the ignition switch 54 includes a button **54*a*. The temporary ignition switch 54 is preferably positioned within the opening 62 of the ignition switch retaining section 50 such button 54*a* is proximate the upper annular surface 66. In the depicted embodiment, the button 54*a* extends slightly proud of or above the annular surface 66**.

The button **54*a* is part of an internal switch mechanism that defines the ignition switch. After linking the keyfob 32 with the ECM 40 (as describe further below) and with the ignition switch 54 connected to the ECM 40 via the connectors 16 and 30, when the button 54*a* is pressed with the vehicle 10** and in an operable mode, the engine (not shown)

is started. The vehicle 10 enters into the operable mode with the ECM 40 recognizes the keyfob 32 and the keyfob 32 is a predetermined range (distance) from the ignition switch 54 (or the permanent ignition switch 34). However, before the vehicle 10 can enter the operable mode, the ECM 40 must first be programmed to recognize and respond to the keyfob 32, as described further below.

As shown in FIG. 12, when the keyfob 32 is installed to the keyfob retaining tool 26, a portion of the keyfob 32 is located directly above the upper annual surface 66 of the ignition switch retaining section 50 and above the button 54*a* (part of the ignition switch mechanism). In the orientation shown in FIG. 12, with one end of the keyfob 32 being located over the opening 62 adjacent to the exposed surface of the button 54*a* (the ignition switch), the keyfob 32 itself can be pressed with a predetermined amount or level of force such that the adjacent end of the keyfob 32 moves into contact with the button 54*a*, thereby pressing on the button 54*a* (the ignition switch).

Figure 14:
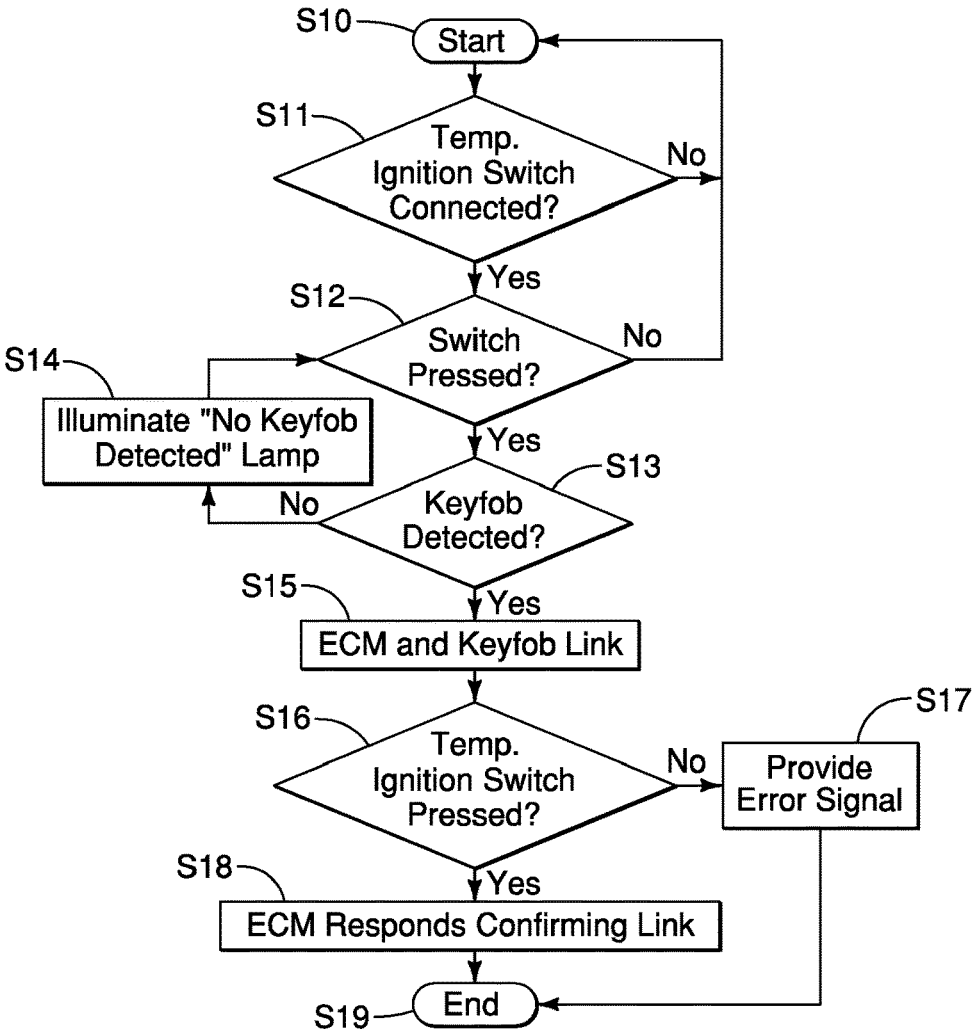
FIG. 14 is a flowchart outlining one example of basic logic for pairing the keyfob with the ECM of the vehicle in accordance with the one embodiment.

A description of the usage of the handheld keyfob retaining tool 26 is now provided with specific reference to the flowchart in FIG. 14. The flowchart in FIG. 14 is one example of basic logic used to program the ECM 40 in order to allow the ECM 40 to recognize the presence of the keyfob 32 when it is close to or within the vehicle 10, and respond to commands transmitted wirelessly from the keyfob 32 to the vehicle 10.

At step S10 in FIG. 14, the vehicle 10 has moved to a station (not shown) in the assembly line (not show) where ECM 40 is to be programmed to recognize and response to the keyfob 32. As shown in FIG. 2, a technician brings the keyfob retaining tool 26 to the vehicle 10 and installs the temporary ignition switch 54 to the vehicle 10 by connecting the connector 30 to the connector 16. This connection establishes a direct electrical connection between the temporary ignition switch 54 and the ECM 40.

At step S11 the ECM 40 determines whether or not the keyfob retaining tool 26 (along with the temporary ignition switch 54) is installed to the vehicle 10. If no, the ECM 40 returns to step S10. If yes, then the ECM 40 moves to step S12. At Step S12, the ECM 40 waits for a predetermined period of time (for example, 10-40 seconds) for the technician to press the button 54*a* (the temporary ignition switch). If the button is not pressed, the ECM 40 returns to step S10. If yes, the ECM 40 is made aware of the presence of the temporary ignition switch 54 and control moves to step S13. At step S13, the ECM 40 determines whether or not the keyfob 32 is present in the keyfob retaining tool 26.

As shown in FIG. 5, the ignition switch 54 and/or the button 54*a* includes an antenna 80 that can transmit signals from the ECM 40 and receive signals from the keyfob 32. The antenna 80 is electronically connected to the ECM 40 via the connector 30. Similarly, the keyfob 32 includes an antenna 82. The ECM 40 and keyfob 32 are preprogrammed to communicate such that the ECM 40 recognizes the presence of the keyfob 32 (and antenna 82) when the keyfob 32 is within a predetermined distance from the antenna 80. The keyfob 32 similarly detects the proximity of the antenna 80.

At step S13, the ECM 40 determines whether or not the presence of the keyfob 32 has been detected. If the keyfob 32 is not present, the ECM 40 moves to step S14. At step S14 the ECM 40 illuminates a lamp (not shown) in the instrument cluster of the instrument panel 14. The lamp illuminates a message that indicates that no keyfob is present for a predetermined period of time alerting the technician to the current condition. Operation then returns to step S12.

At step S13, if the keyfob 32 has been detected by the ECM 40 via the antennas 80 and 82, operation then moves to step S15. At step S15, automatic communications between the ECM 40 and the keyfob 32 commence where the ECM 40 receives a code or codes from the keyfob 32 unique to the keyfob 32. The ECM 40 stores the code or codes identifying the keyfob 32. Thereafter, the ECM 40 response to all commands from the keyfob 32. The commands from the keyfob 32 are preprogrammed commands linked to the pressing of buttons on the keyfob 32 in a conventional manner. This operation electronically pairs the keyfob 32 with the ECM 40 of the vehicle 10. The ECM 40 then illuminates another lamp or lamp on the instrument cluster confirming to the technician that the pairing operation is complete. Operation then moves to step S16.

At step S16, the technician presses on the keyfob 32 causing it to move into contact with the ignition switch button 54*a* thereby signaling to the ECM 40 to start the engine 44 of the vehicle 10. It should be understood from the drawings and the description herein that, alternatively, the technician can merely press the button 54*a* without pressing on the keyfob 32. The ECM 40 is programmed to wait a predetermined period of time (for example, 10-40 seconds) for the pressing of the button 54*a*. If the button 54*a* is not pressed within that period of time, then operation moves to step S17 where an error signal is actuated by the ECM 40. The error signal can be a noise (the horn), a lamp being illuminated or lamps being caused to blink informing the technician of a problem.

If the ECM 40 detects that the button 54*a* is pressed within the predetermined period of time, then operation moves to step S18 where the ECM 40 provides an indication of completion of the pairing process. The indication can be, for example, lamps being illuminated, or if ready, the engine 44 can be started. Operation then moves to step S19 where the operation is ended.

As shown in FIG. 4, once the pairing operation depicted in the flowchart in FIG. 4 (and shown in phantom in FIG. 5) is completed, the keyfob retaining tool 26 is removed and shortly thereafter the center console 22 is installed. When the center console 22 is installed, the permanent ignition switch 34 is already installed to the center console 22, and its corresponding electric connector is then attached to the connector 16 of the wiring harness 18 of the vehicle 10.

During the vehicle assembly process partially depicted in FIGS. 1-4, the operation of programming the ECM 40 to pair with the keyfob 32 (FIGS. 1-3) can occur several assembly steps prior to the installation of the center console and the permanent ignition switch 34. The use of the handheld tool (the keyfob retaining tool 26) makes it possible to more flexibly assemble features of the vehicle without the need to install the center console 22 in order to pair the keyfob 32 with the ECM 40. Efficiency can be improved in the assembly line. Further since the keyfob retaining tool 26 is a hand-held tool requiring only a single hand to manipulate, the technician has a free hand to insert the keyfob 32 into the keyfob retaining tool 26 and perform other tasks with the vehicle 10 in the same assembly line location or station.

FIG. 14 shows a flow chart that outlines basic logic conducted by the ECM 40 during the assembly steps represented in FIG. 1-4. As shown in FIG. 5, the The ECM 40 is an electronic controller that preferably includes a microcomputer with a keyfob linking and command control program that controls the linking process described herein. The electronic controller (ECM 40) can also include other conventional components such as an input interface circuit, an output interface circuit, and storage devices such as a ROM (Read Only Memory) device and a RAM (Random Access Memory) device. The microcomputer of the electronic controller (ECM 40) is programmed to control various vehicle operations, engine and transmission control, etc., as well as the keyfob linking process (initialization process). The memory circuit stores processing results and control programs such as ones for the keyfob linking process (initialization process) that are run by the processor circuit. The electronic controller (ECM 40) is operatively coupled to the various elements and electronic components of the vehicle in a conventional manner. The internal RAM of the electronic controller (ECM 40) stores statuses of operational flags and various control data. The electronic controller (ECM 40) is capable of selectively controlling any of the components of the control system in accordance with the control program. It will be apparent to those skilled in the art from this disclosure that the precise structure and algorithms for the electronic controller (ECM 40) can be any combination of hardware and software that will carry out the functions of the present invention.

The various vehicle elements such as, for example, the instrument panel 14 and the engine 44 are conventional components that are well known in the art. Since these vehicle elements are well known in the art, these structures will not be discussed or illustrated in detail herein. Rather, it will be apparent to those skilled in the art from this disclosure that the components can be any type of structure and/or programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment, the following directional terms "forward", "rearward", "above", "downward", "vertical", "horizontal", "below" and "transverse" as well as any other similar directional terms refer to those directions of a vehicle equipped with the keyfob retaining tool 26. Accordingly, these terms, as utilized to describe the present invention should be interpreted relative to a vehicle equipped with the keyfob retaining tool.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A keyfob retaining tool, comprising: an ignition switch retaining section; a keyfob retaining section attached to the ignition switch retaining section; and an ignition switch installed to the ignition switch retaining section, the ignitions switch being configured to temporarily connect to wiring of a vehicle for electronic communication with an ECM (electronic control module) of the vehicle and the keyfob retaining section being configured to temporarily retain a keyfob adjacent to the ignition switch such that the keyfob establishes a communication connection via the ignition switch with the ECM of the vehicle in order to electronically pair the keyfob with the ECM of the vehicle.

2. The keyfob retaining tool according to claim 1, wherein the keyfob retaining section is configured to retain the keyfob within a predetermined distance range from an exposed surface of the ignition switch such that an antenna within the keyfob and an antenna within the ignition switch establish a wireless connection therebetween.

3. The keyfob retaining tool according to claim 1, wherein the ignition switch retaining section has an overall annular shape with an opening extending therethrough.

4. The keyfob retaining tool according to claim 3, wherein the opening extending through the ignition switch retaining section includes a plurality of radially inwardly extending projections dimensioned to retain the ignition switch within the opening, with an exposed surface of the ignition switch being located proximate one end surface of the ignition switch retaining section.

5. The keyfob retaining tool according to claim 4, wherein the keyfob retaining section is attached to an outer surface of the ignition switch retaining section.

6. The keyfob retaining tool according to claim 5, wherein the keyfob retaining section includes an attachment section that is attached to the ignition switch retaining section and includes a pair of arms that extend away from the attachment section over one end of the opening.

7. The keyfob retaining tool according to claim 6, wherein the pair of arms being biased toward one another in order to removably retain the keyfob therebetween with one end of the keyfob being located over the opening adjacent to the exposed surface of the ignition switch.

8. The keyfob retaining tool according to claim 7, wherein the pair of arms are shaped and dimensioned such that with the keyfob disposed therebetween adjacent to the exposed surface of the ignition switch, the keyfob is easily moved by a technician into contact with the exposed surface of the ignition switch such that pressing the exposed surface with a predetermined level of force causes the ignition switch to send a signal to the ECM.

9. The keyfob retaining tool according to claim 1, wherein the keyfob retaining section is attached to an exposed surface of the ignition switch retaining section.

10. The keyfob retaining tool according to claim 9, wherein the keyfob retaining section includes an attachment section that is attached to the ignition switch retaining section, and, includes a pair of arms that extend away from the attachment section over one end of an opening in the ignition switch retaining section.

11. The keyfob retaining tool according to claim 10, wherein the pair of arms are biased toward one another in order to removably retain the keyfob therebetween with one end of the keyfob being located over the opening adjacent to the exposed surface of the ignition switch.

12. The keyfob retaining tool according to claim 11, wherein the pair of arms are shaped and dimensioned such that with the keyfob disposed therebetween adjacent to the exposed surface of the ignition switch, the keyfob is easily moved by a technician into contact with the exposed surface of the ignition switch such that pressing the exposed surface with a predetermined level of force causes the ignition switch to send a signal to the ECM.

13. A keyfob retaining tool, comprising: a hand-held structure that includes an ignition switch installed therein and a keyfob retaining section configured to temporarily retain a keyfob therein, the ignition switch being configured to temporarily connect to wiring of a vehicle for electronic communication with an ECM (electronic control module) of the vehicle and the keyfob retaining section being configured to temporarily retain a keyfob adjacent to the ignition switch such that the keyfob establishes a communication connection via the ignition switch with the ECM of the vehicle in order to electronically pair the keyfob with the ECM of the vehicle.

14. The keyfob retaining tool according to claim 13, wherein the hand-held structure includes an ignition switch retaining section with the keyfob retaining section being fixedly attached thereto.

15. The keyfob retaining tool according to claim 14, wherein the keyfob retaining section includes a pair of arms that extend away from the attachment section over one end of an opening in the ignition switch retaining section.

16. The keyfob retaining tool according to claim 15, wherein the pair of arms are biased toward one another in order to removably retain the keyfob therebetween with one end of the keyfob being located over the opening adjacent to the exposed surface of the ignition switch within a predetermined distance range from an exposed surface of the ignition switch such that an antenna within the keyfob and an antenna within the ignition switch establish a wireless connection therebetween.

17. The keyfob retaining tool according to claim 14, wherein the ignition switch retaining section has an overall annular shape with the opening extending therethrough, a cylindrically shaped surface that defines the opening includes a plurality of radially inwardly extending projections dimensioned to retain the ignition switch within the opening, with the exposed surface of the ignition switch being located proximate one end surface of the ignition switch retaining section.

* * * * *